US005099538A

United States Patent [19]

Gaconnet

[11] Patent Number: 5,099,538

[45] Date of Patent: Mar. 31, 1992

[54] MINIATURE DUAL ACTION APPARATUS

[76] Inventor: James D. Gaconnet, P.O. Box 685, Weatherford, Tex. 76086

[21] Appl. No.: 689,965

[22] Filed: Apr. 23, 1991

[51] Int. Cl.[5] ..... A47L 11/12

[52] U.S. Cl. ..... 15/93.1; 15/236.01; 51/170 MT; 51/181 R

[58] Field of Search ..... 51/170 R, 170 MT, 181 R; 15/93.1, 22.2, 49.1, 236.01; 30/169, 272.1, 277.4

[56] References Cited

U.S. PATENT DOCUMENTS

| | | | |
|---|---|---|---|
| 3,364,625 | 1/1968 | Sogge | 51/170 MT |
| 3,482,362 | 12/1969 | Bangerter et al. | 51/170 R |
| 4,516,358 | 5/1985 | Marton et al. | 51/170 MT |
| 4,821,357 | 4/1989 | Millette | 51/170 MT |
| 4,986,036 | 1/1991 | Hutchins | 51/170 R |

FOREIGN PATENT DOCUMENTS

| | | | |
|---|---|---|---|
| 2745129 | 4/1959 | Fed. Rep. of Germany | 51/170 MT |
| 3805926 | 9/1989 | Fed. Rep. of Germany | 51/170 R |
| 2148770 | 6/1985 | United Kingdom | 15/93.1 |

*Primary Examiner*—Roscoe V. Parker
*Attorney, Agent, or Firm*—Geoffrey A. Mantooth

[57] ABSTRACT

A dual action apparatus has a body with first and second ends. A shaft extends from the first end. The shaft is adapted to be received by a drive motor. A cavity is formed in the second end of the body. The apparatus also has an inner shaft, with inner and outer ends. Bearings are received on the inner end of the inner shaft. The bearings and the inner shaft are located within the cavity of the body such that the longitudinal axis of the body. A retainer ring is used to retain the inner shaft and the bearings inside of the body. The outer end of the inner shaft receives a sanding pad or a scraper blade. The scraper blade has an opening through the blade, which opening receives the outer end of the inner shaft. A nut retains the scraper blade onto the inner shaft.

5 Claims, 1 Drawing Sheet

MINIATURE DUAL ACTION APPARATUS

FIELD OF THE INVENTION

The present invention relates to dual action apparatuses that impart motion to accessory tools such as sanders and the like.

BACKGROUND OF THE INVENTION

Dual action or multi-action sanders are used in automotive body work to remove paint, smooth filling compound and similar operations. The sanders have drive motors that produce rotary power. The motors rotate sanding pads, onto which is placed sanding paper.

The motors generally rotate at a fairly high speed or revolutions per minute. If the sanding pads were rotated at the same high speed, then it would be difficult for an operator to conduct delicate sanding operations requiring only light sanding. Oversanding and gouging of surfaces would occur.

In order to slow down the speed of the sanding pads, and also the sandpaper carried by the sanding pads, the sander is provided with a dual action device. The dual action device effectively acts as a transmission, and transmits only a small portion of the rotary power from the motor to the sanding pad. Thus, the sanding pad rotates at a slower speed than the motor. This allows an operator to better control the sanding operation of the sandpaper.

Prior art dual action sanders are typically too large to be used in small spaces such as are encountered in automotive body work.

It is therefore an object of the present invention to provide a dual action apparatus that can operate in small spaces.

It is a further object of the present invention to provide a scraper blade accessory on a dual action apparatus such that motion is imparted by the dual action apparatus to the scraper blade accessory.

DESCRIPTION OF PREFERRED EMBODIMENTS

Figure 1:
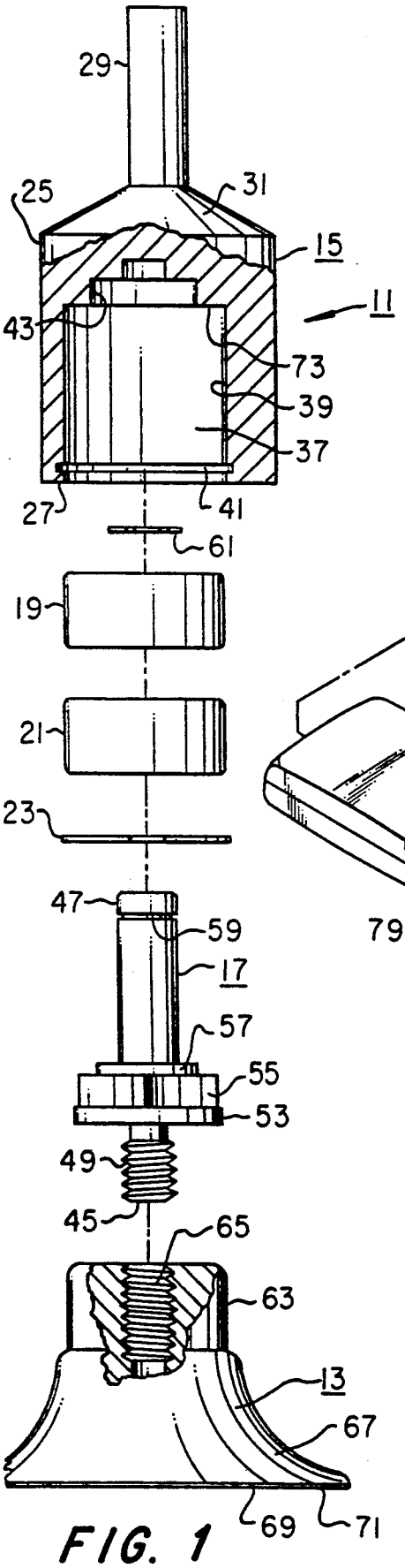
FIG. 1 is an exploded view of the miniature dual action apparatus of the present invention, in accordance with a preferred embodiment, shown with a sanding pad.

In FIG. 1, there is shown an exploded view of the miniature dual action apparatus 11. The apparatus 11 is used to impart some of the rotary motion from a motor to an accessory such as a sanding pad 13.

The apparatus 11 includes a body 15, an inner shaft 17, first and second bearings 19, 21 and an outer retainer ring 23.

Figure 2:
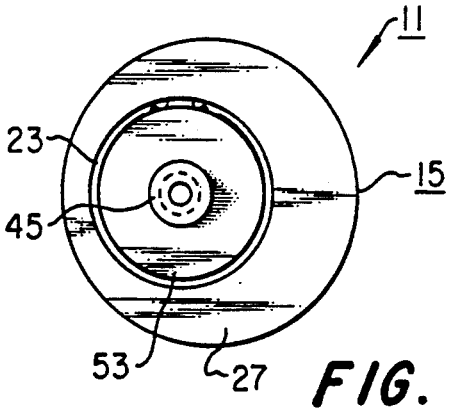
FIG. 2 is an end view of the apparatus of FIG. 1, shown without the sanding pad.

The body 15 is generally cylindrical and has two ends 25, 27. A shaft 29 extends longitudinally from one end 25. A frusto-conical portion 31 is used to taper from the large diameter body 15 to the small diameter shaft 29. The shaft 29 is adapted to be received by a drill chuck 33 on a drill 35 (see FIG. 3), which provides rotary motion to the apparatus. At the other end 27 of the body is a cavity 37. The cavity 37 extends longitudinally from the end 27 of the body 15 toward the other end 25. The cavity is formed by a cylindrical bore 39 that opens to the outside. As shown in FIGS. 1 and 2, the bore is eccentrically located within the body so as to be off center. This off centering produces the dual action of the apparatus. Near the open end of the bore 39 is a circumferential groove 41 that receives the outer retainer ring 23. At the closed end of the bore is a cylindrical counterbore 43.

The inner shaft 17 has outer and inner ends 45, 47. The outer end 45 is threaded 49 to receive the sanding pad 13 or a retaining nut 51 (see FIG. 3). Just inwardly of the threads is a flat disc portion 53 coupled to the inner shaft 17. The disc portion 53 rotates and moves with the inner shaft 17. The disc portion 53 acts as a stop upon which the accessory sanding pad 13 bears. Adjacent to the inward side of the disc portion 53 is a square nut 55, which is also coupled to the inner shaft so as to rotate therewith. The square nut 55 has a cylindrical portion machined on its inner end. The diameter of the cylindrical portion 57 is such that the outer retainer ring 23 is located around the cylindrical portion when the apparatus is assembled. Inwardly of the square nut 55, the inner shaft 17 is smooth for receiving the first and second bearings 19, 21. At the inner end 47 of the inner shaft is a circumferential groove 59 for receiving an inner retainer ring 61.

The first and second bearings 19, 21 are conventional. They are generally cylindrical and are of the sealed bearing type.

The sanding pad 13 is also conventional. The sanding pad 13 has a mounting portion 63 with a threaded bore 65 for coupling onto the inner shaft outer end 45. The pad 13 also has a base portion 67 with a flat surface 69 that is circular in shape. Sandpaper 71 is located on this flat surface 69 and is retained with an adhesive. The base portion 67 is typically made of an elastomeric compound such as rubber.

To assemble the various components of the apparatus 11, the outer retainer ring 23 is located on the cylindrical portion 57 of the inner shaft 17. Then, the two bearings 19, 21 are located on the inner shaft 17 at a position between the cylindrical portion 57 and the cirumferential groove 59. The bearings 19, 21 are retained on the inner shaft by the inner retaining ring 61, which is installed into the groove 59.

Next, the inner shaft-bearing assembly 17, 19, 21 is installed into the cavity 37 of the body 15. The bearings 19, 21 have an interference fit with the cylindrical bore 39. The inner end 47 of the inner shaft is received by the counterbore 43. The longitudinal axis of the inner shaft 17 is offset from the longitudinal or rotational axis of the body 15 and the outer shaft 29, by virtue of the eccentric location of the bore 39. The first or innermost bearing 19 contacts the shoulder 73 between the bore 39 and the counterbore 43 to longitudinally position the inner shaft-bearing assembly within the body. Once assembled, the square nut 55 protrudes out from the body so as to be accessible to a wrench. The outer retainer ring 23 is installed into the groove 41 of the body to retain the inner shaft-bearing assembly in the body. The assembly of the apparatus is complete.

To use the apparatus 11 of the present invention, an accessory device is selected and coupled to the outer end of the inner shaft. For example, if the sanding pad 13 is selected, it is threaded onto the inner shaft 17. A wrench is used to hold the inner shaft 17 at the square nut 55 when tightening the sanding pad on to the inner shaft. The shaft 29 of the accessory is then inserted into a drill chuck 33 of a drill 35. The drill 35 is then operated.

Because the inner shaft 17 is coupled to the body 15 by way of the bearings 19, 21, the shaft rotates independently of the body. Likewise, the body rotates independently of the shaft. If the inner shaft was centered within the body such that the longitudinal axis of the inner shaft was coincident with the rotational axis of the body and the outer shaft 29, then as the body rotated, the sanding pad would not move whenever the sanding pad was pressed up against an object to be sanded. This is because the body rotates independently of the inner shaft.

But, the inner shaft 17 is actually offset from the rotational axis of the body 15. Therefore, as the body is rotated, the longitudinal axis of the inner shaft will describe a circle around the longitudinal axis of the body. The sanding pad 13 may not rotate but it will move in a circular motion. This circular motion is sufficient to provide sanding action.

The apparatus 11 is designed to be used in small, hard to reach places. In the preferred embodiment, the diameter of the sanding pad flat surface 69 is 1.75 inches. The outer diameter of the body 15 is 1 inch. The inside diameter of the bore 39 is 11/16 inches. The length of the cylindrical portion of the body is 1 1/16 inches. With the small size of the apparatus 11, the retainer ring 23 is used to retain the inner shaft 17 and bearings 19, 21 inside of the body 15.

The provision of two bearings 19, 21, instead of one bearing, stabilizes the inner shaft. Thus, the inner shaft is firmly held in its alignment relative to the body and will not wobble during operation.

Figure 3:
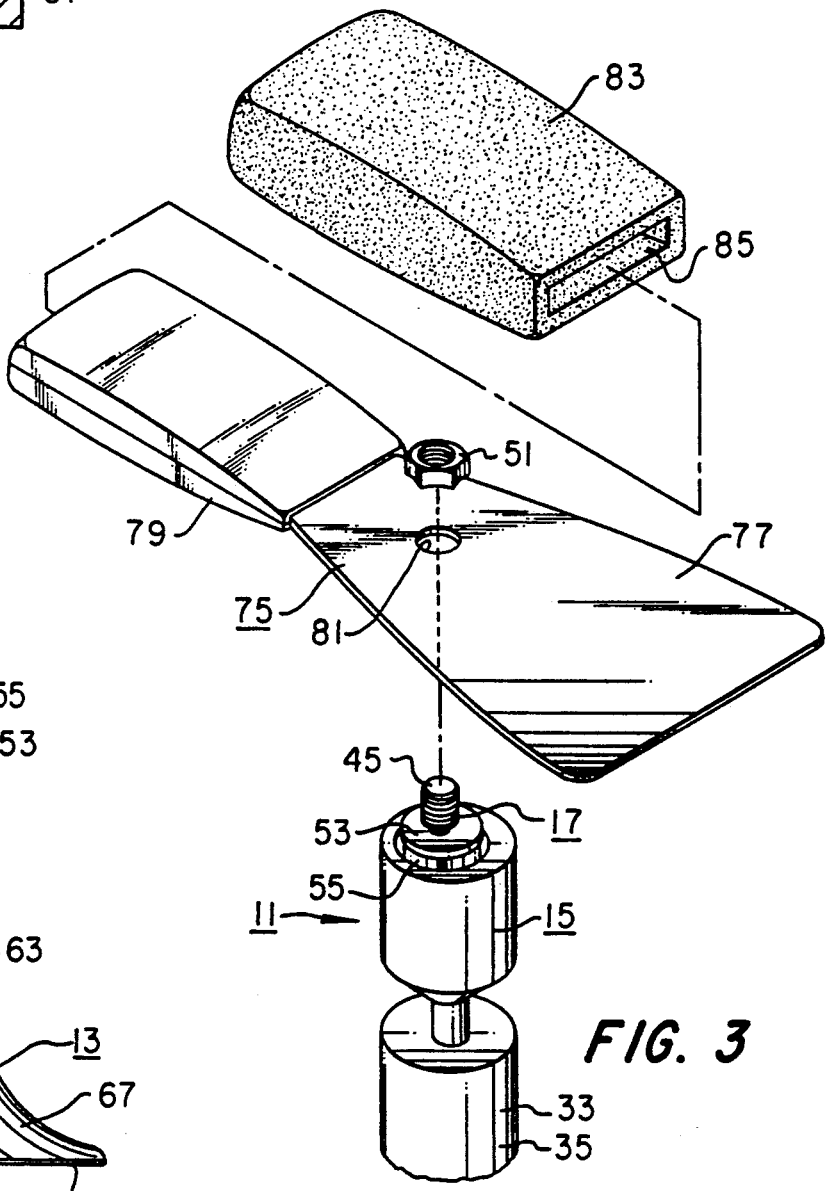
FIG. 3 is an isometric view of the apparatus of FIG. 1, shown with a scraper blade.

In FIG. 3, there is shown the apparatus 11 with another accessory. The accessory is a conventional scraper blade 75 or putty knife. The scraper blade 75 has a blade portion 77 and a handle portion 79. The handle portion 79 is coupled to the blade portion 77. The blade portion 77 has an opening 81 therethrough, located near the handle portion. The opening is provided for coupling the scraper blade to the apparatus. The opening 81 receives the outer end 45 of the inner shaft 17. A nut 51 retains the scraper blade onto the inner shaft. When assembled, the blade portion 77 contacts the disc portion 53 of the inner shaft 17. A resilient foam handle 83 is provided. The handle 83 has a cavity 85 therein for receiving the handle portion 79 of the scraper blade. The handle 83 dampens the vibrations of the handle portion, allowing an operator to more easily grasp and control the scraper blade. The handle is made of a dense rubber foam.

To use the scraper blade 75, the apparatus is rotated with a drill 35. The operator uses one hand to hold and operate the drill, while the other hand is used to guide the scraper blade.

As the body is rotated, the inner shaft is moved in a circular motion as described above. The inner shaft 17 moves or vibrates the scraper blade 75 in an orbital fashion. The scraper blade can be used to remove trim decals from cars, trucks and the like. With the motion provided by the apparatus, the time and effort required to reduce trim is reduced.

The foregoing disclosure and the showings made in the drawings are merely illustrative of the principles of this invention and are not to be interpreted in a limiting sense.

I claim:

1. A dual action apparatus, comprising:

a) a body having first and second ends, said body having a shaft extending from said first end, said shaft being adapted to be received by motor means for providing rotary power, said body having a cavity located in said second end;

b) an inner shaft having an outer end and an inner end, said inner shaft having bearing means located thereon near said inner end, said inner shaft and said bearing means being located within said cavity such that said inner shaft is offset from a rotational axis of said body;

c) retaining means for retaining said inner shaft in said cavity;

d) a scraper blade having a handle portion and a blade portion, said scraper blade being coupled to said outer end of said inner shaft.

2. The apparatus of claim 1 wherein said scraper blade has an opening through the blade portion, said opening receiving said inner shaft outer end, said apparatus further comprising securing means for securing said scraper blade onto said inner shaft.

3. The apparatus of claim 2 further comprising a soft and resilient foam handle located around said handle portion of said scraper blade.

4. The apparatus of claim 1 further comprising a soft and resilient foam handle located around said handle portion of said scraper blade.

5. The apparatus of claim 1 wherein said retaining means comprises a retainer ring that receives said inner shaft and that is received by a circumferential groove in said cavity.

* * * * *